US010392229B2

(12) United States Patent
Salvenmoser

(10) Patent No.: US 10,392,229 B2
(45) Date of Patent: Aug. 27, 2019

(54) DEVICE FOR ACTUATING A CAR OR SHAFT DOOR OF AN ELEVATOR SYSTEM

(71) Applicant: Michael Salvenmoser, Hitzkirch (CH)

(72) Inventor: Michael Salvenmoser, Hitzkirch (CH)

( * ) Notice: Subject to any disclaimer, the term of this patent is extended or adjusted under 35 U.S.C. 154(b) by 261 days.

(21) Appl. No.: 15/506,283

(22) PCT Filed: Aug. 21, 2015

(86) PCT No.: PCT/EP2015/069253
§ 371 (c)(1),
(2) Date: Feb. 24, 2017

(87) PCT Pub. No.: WO2016/030296
PCT Pub. Date: Mar. 3, 2016

(65) Prior Publication Data

US 2017/0267494 A1 Sep. 21, 2017

(30) Foreign Application Priority Data

Aug. 25, 2014 (CH) ..... 1300/14

(51) Int. Cl.
*B66B 13/12* (2006.01)
*B66B 13/08* (2006.01)

(52) U.S. Cl.
CPC ..... *B66B 13/12* (2013.01); *B66B 13/08* (2013.01)

(58) Field of Classification Search
CPC ..... B66B 13/12; B66B 13/08
See application file for complete search history.

(56) References Cited

U.S. PATENT DOCUMENTS 2,996,152 A 8/1961 Olexson
3,033,317 A 5/1962 Beck et al.
3,913,270 A 10/1975 Kumagai
5,487,449 A * 1/1996 Barrett ..... B66B 13/12 187/330
8,607,937 B2 12/2013 Gilli
(Continued)

FOREIGN PATENT DOCUMENTS

CA 2267428 A1 4/1994
EP 0829447 A1 3/1998
(Continued)

OTHER PUBLICATIONS

Abstract of JPH05162956.

*Primary Examiner* — Diem M Tran
(74) *Attorney, Agent, or Firm* — Brian Roffe

(57) ABSTRACT

Device for a lift system for actuating at least one cabin or shaft door is provided with a coupling mechanism which can be fastened to a moveable cabin door of a cabin. In addition, a plate unit co-operating with the coupling mechanism is provided which can be fixed onto a shaft door on the respective story. The coupling mechanism has a coupling element that can be adjusted transversely to the latter or to the cabin door and can be moved from a drawn back position into a position coupled with a counter-element of the plate unit. This adjustable coupling element and the counter-element of the plate unit are advantageously each magnetic, by means of which sufficient adhesive force can be generated in the coupled position. This device enables proper functioning during operation of a lift system, even if there are breakdowns.

20 Claims, 3 Drawing Sheets

(56) References Cited

U.S. PATENT DOCUMENTS

| | | | | |
|---|---|---|---|---|
| 8,678,141 | B2 | 3/2014 | Gieras et al. | |
| 8,746,412 | B2 | 6/2014 | Rebillard et al. | |
| 2015/0329326 | A1* | 11/2015 | Mittermayr ..... | B66B 13/12<br>187/330 |

FOREIGN PATENT DOCUMENTS

| | | | |
|---|---|---|---|
| EP | 2297018 | B1 | 5/2013 |
| GB | 712722 | A | 7/1954 |
| JP | 05162956 | A | 6/1993 |
| WO | 1998014395 | A1 | 4/1998 |
| WO | 2016030296 | A1 | 3/2016 |

* cited by examiner

DEVICE FOR ACTUATING A CAR OR SHAFT DOOR OF AN ELEVATOR SYSTEM

FIELD OF THE INVENTION

The invention relates to a device, preferably for a lift system, for actuating at least one cabin or shaft door that includes a coupling mechanism which can be fastened to a moveable cabin door of a cabin or to a shaft door on the respective story, and a plate unit co-operating with the coupling mechanism and which can be fixed onto the shaft door on the respective story or to the cabin door.

BACKGROUND OF THE INVENTION

In a known lift according to publication EP-A-2 297 018 a lift cabin is provided in a known manner with horizontally moveable cabin door leaves, and on the stories it is provided in a known manner with corresponding shaft door leaves, these door leaves being arranged parallel to one another. In order to open and close the cabin door leaves a door drive and, moreover, a coupling device is provided which involves transfer of the corresponding movements to the shaft door wing, and for this purpose at least one moveable entraining element is provided which is brought into contact with a counter-element provided on the shaft door leaf. In addition, a door lock with a cabin door lock and a lock stop are assigned to the cabin door leaf. A blocking effect of this door lock is dependent upon the co-operation of the coupling device and the counter-element. This is monitored by a lift control system with which, by means of a safety switch which is provided on the door lock, opening of the door leaf is prevented if the lift cabin is not exactly at the level of the story.

The movement of the cabin door lock is coupled rigidly with that of the entraining element. If the entraining element is located in a pass-through position a distance away from the counter-element of the shaft door leaf or moves further than to a defined coupling position, the cabin door lock thus blocks opening of the lock stop and so of the cabin door leaf. On the other hand, the latter can be opened if the entraining element is halted by the counter-element in a defined coupling position.

Two entraining elements of a cabin door leaf are respectively provided between two counter-elements of the shaft door leaf if the lift cabin is at the level of the story, the entraining elements being pressed against the counter-elements by a spring before opening of the cabin door leaf starts.

OBJECTS AND SUMMARY OF THE INVENTION

Proceeding from these known lifts it is the object of the invention to devise a device for operating at least one cabin or shaft door and which, fulfilling all of the required functions for operation of a lift, offers a space-saving and reliable design.

According to the invention, this object is achieved by providing the coupling mechanism with a coupling element that can be adjusted transversely to the latter or to the cabin door or the shaft door and which can be moved from a drawn back position into a position coupled with a counter-element of the plate unit.

According to the invention, the coupling mechanism for the cabin door has a coupling element that can be adjusted transversely to the cabin door and which can be moved from a drawn back position into a position coupled with a counter-element of the plate unit for the shaft door.

This structure according to the invention of the device enables proper functioning during operation of a lift system even if there are breakdowns. Opening and closure of the cabin door and the shaft door can thus be executed easily.

In addition, one of the essential advantages is that with the structure according to the invention of the device, in contrast to the known lifts, one can achieve a reduction in the gap between the cabin and the shaft on the door side, it being possible to reduce said gap from approx. 30 to 10 mm. In this way, in addition to approving the appearance, one also reduces the risk of narrow objects such as keys, money or the like being able to fall through this gap into the lift shaft.

Very advantageously, this adjustable coupling element of the coupling mechanism and the counter-element of the plate unit are made in the form of magnetic plates by means of which a sufficient adhesive force can be generated in the coupled position. In this way coupling can take place very efficiently and reliably, and by drawing back the coupling element in this way no space is required when the doors are closed.

This device according to the invention is also suitable for the upgrading and modernisation of existing lift systems. In addition, with older or very high buildings, the associated changing and high tolerances between the lift cabin and the lift shaft or the shaft walls due to building subsidence, changing dimensions etc. can be compensated for without any problem.

BRIEF DESCRIPTION OF THE DRAWINGS

Exemplary embodiments and additional advantages of the invention are described in more detail below by means of drawings. These show as follows.

DETAILED DESCRIPTION OF THE INVENTION

Figure 1:
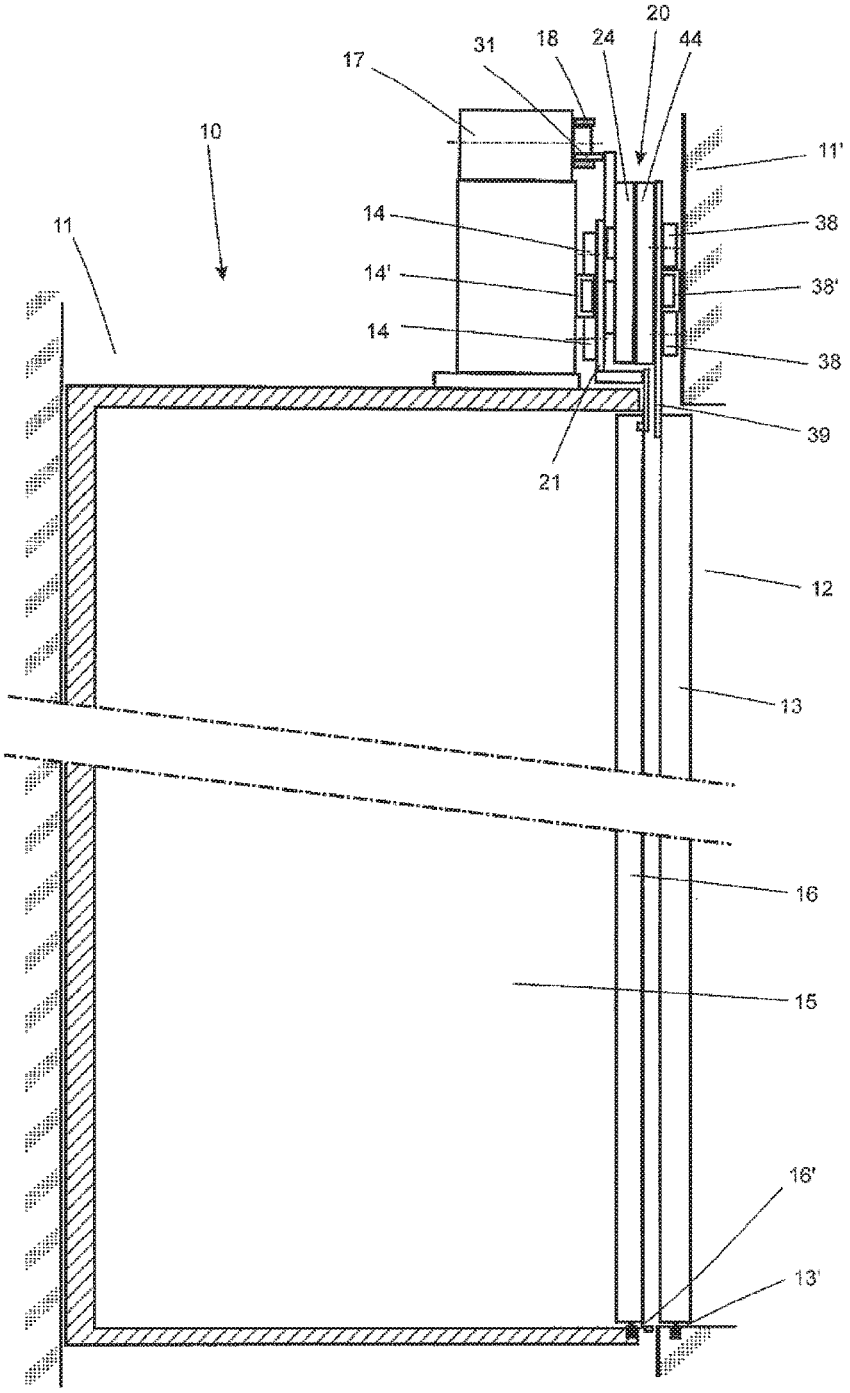
FIG. 1 is a diagrammatic partial longitudinal section of a lift system according to the invention.

In a partially illustrated lift system 10 according to FIG. 1 a lift shaft 11 and a cabin 15 guided within the latter and that can be moved up and down are indicated. This cabin that is held in a known manner by cables or the like can be guided within the lift shaft 11 to the individual stories 12 by a corresponding control system.

These types of lift systems are primarily installed in houses, office buildings, commercial buildings or the like, and they serve to convey people, animals and/or objects of all types. They are also particularly suitable for lift systems which are made with shafts running at least partially in a horizontal direction.

There are provided both on the cabin 15 and on each of the respective stories 12, at least one cabin door 16 and a shaft door 13 which can be opened and closed transversely to the plane of the figure. Depending on the space available, two or more such doors can also be installed for each cabin and for each story. Assigned to the upper side of the doors 13, 16 are rollers 14, 38, respectively, which are guided on securely installed guide rails 14', 38' on the one hand, on the cabin 15 and on the other hand, in the shaft wall 11'. On the lower side, these doors 13, 16 are advantageously guided in longitudinal guides 13', 16', respectively.

A device 20 for operating the cabin or shaft door 13, 16 is advantageously positioned on the upper side of the cabin 15. A drive motor 17 that can be actuated by a control system is disposed on the upper side of the cabin, which drive motor generally drives a circulating toothed belt as a drive element 18 for the doors 13, 16.

Figure 2:
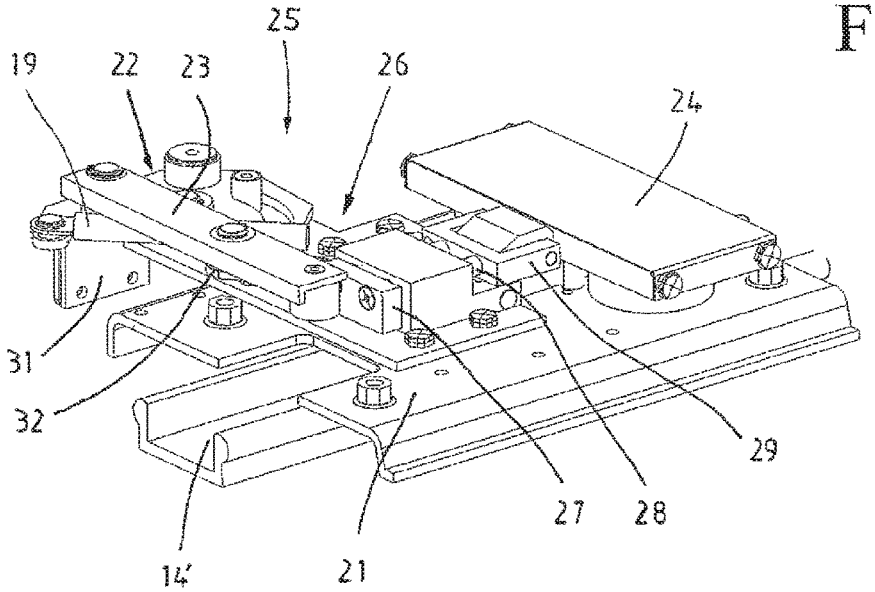
FIG. 2 is a perspective view of a coupling mechanism according to the invention of the lift system in the closed position of the doors and which is connected to the cabin door.
Figure 3:
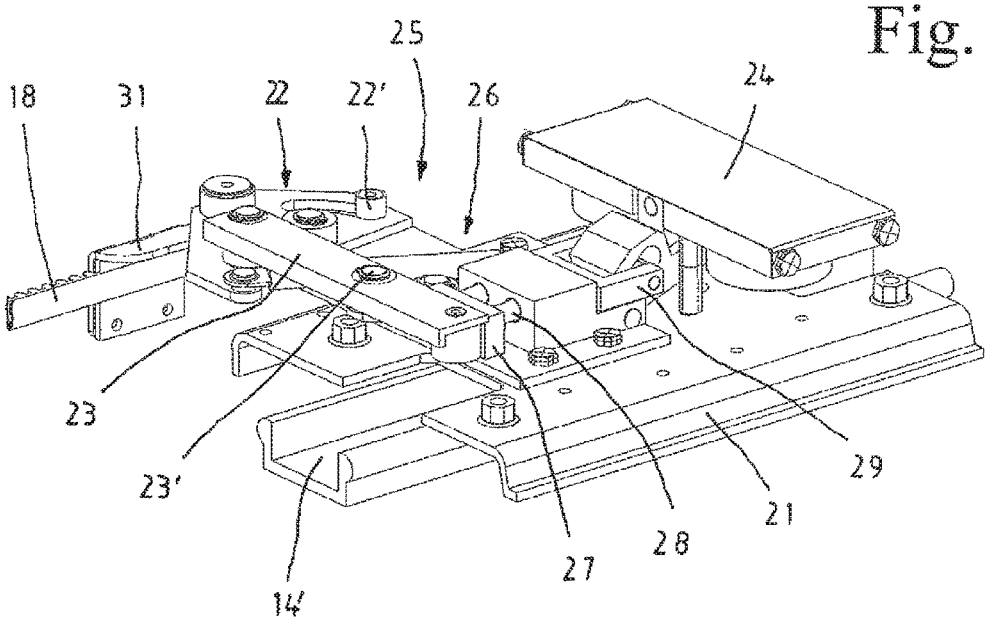
FIG. 3 is a perspective view of the coupling mechanism according to FIG. 2 during opening and closure of the doors.

FIGS. 2 and FIG. 3 show a coupling mechanism 25 of the device 20 which can be fastened to the moveable cabin door 16 and in the fitted state, as can be seen in FIG. 1, is arranged in vertical alignment. The partially shown guide rail 14' is fastened in its longitudinal extension running horizontally on the drive motor 17, and the rollers 14 indicated in FIG. 1 are mounted rotatably on a base plate 21 that can be fastened to the cabin door 16.

According to the invention, the coupling mechanism 25 has a coupling element 24 that can be adjusted transversely to the coupling mechanism 25 or to the cabin door 16 and which can be moved from a drawn back position, as can be seen in FIG. 2, into a position coupled with a counter-element 44 of the plate unit 40, as shown in FIG. 3.

Very advantageously the adjustable coupling element 24 of the coupling mechanism 25 and the counter-element 44 of the plate unit 40 are each in the form of a magnetic plate by means of which in the coupled position a sufficient adhesive force can be generated which can be further assisted by compression springs (not shown). The coupling element 24 consists here of one or a number of magnets. Rapid and effective coupling between the cabin and the shaft door can thus be brought about.

According to FIG. 2 and FIG. 3 the coupling mechanism 25 comprises an adjusting device 26 for the coupling element 24, a rocker 22 that can be connected to the drive element 18 of the door drive by a clamp 31, and a pivotable transfer element 23 which are disposed on the base plate 21. The adjusting device 26 is provided with a carriage 27 with at least one, in this case two, guide rods 28 and with a swivel element 29 hinged on the latter for the transverse adjustment of the coupling element 24 mounted perpendicularly in the base plate 21, the longitudinally moveable carriage 27 being coupled to the rotatably mounted transfer element 23.

If the doors are now to be opened by the lift control system, this rocker 22 co-operating with a stop bolt 22' is swivelled about a specific angle by a tension element 19 from the position of the coupling mechanism 25 according to FIG. 2 by means of a release brought about by the lift control system, and so coupling of the clamp 31 with the toothed belt 18 is brought about. The transfer element 23 is, as it were, turned about a swivel axis 23' of a lever 32 mounted flexibly on the base plate 21 and the adjusting device 26 is actuated so that the swivel element 29 triggers this transverse movement of the coupling element 24 until the latter is connected to the counter-element 44 according to the position shown in FIG. 3. After the doors have been closed, the coupling element 24 is brought back in the opposite direction into the position according to FIG. 2.

Figure 4:
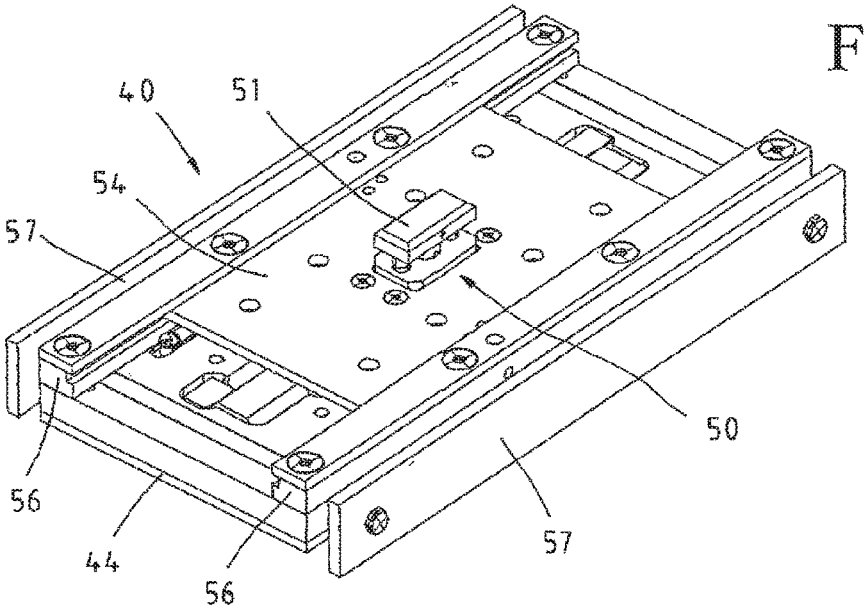
FIG. 4 is a perspective view of a plate unit co-operating with the coupling mechanism according to FIG. 2 and which is connected to the shaft door.

FIG. 4 shows the plate unit 40 co-operating with the coupling mechanism 25 and which is coupled with the shaft door 13 on the respective story 12 and is likewise fitted vertically. A covering plate 54 that can be connected on the rear side to the shaft door 13 and the counter-element 44 that can be height-adjusted with said covering plate via lateral sliding guides 56 are provided here. Advantageously the counter-element 44 is held by means, for example a spring, such that it can be adjusted upwards or downwards from a rest position.

It is thus achieved as a further advantage of the invention that after coupling the coupling element 24 with the counter-element 44, any height changes to the cabin 15 when people are getting in or out or during loading and unloading can be compensated for by this counter-element with the coupling element and the cabin being able to move slightly downwards or upwards.

Within the framework of the invention a magnetically formed counter-element 44 and a locking component 50 are formed in this plate unit 40. This locking component 50 is mounted moveably perpendicular to the plane of the plate here and can be moved from a locked initial position into a disengaged position towards the coupling element 24, by means of which the plate unit 40, and with it the shaft door 13, can be brought into a fixed or into a released position.

With these improvements to the device according to the invention, unlike with the known devices, premature opening of the lift or shaft doors can also be avoided.

In the shown position of the rear side of the plate unit 40 according to FIG. 4 this locking component 50 is in the locked initial position in which opening of the shaft door 13 while the lift is moving is prevented because a cam 51 advantageously engages in a groove or the like (not shown) in the shaft wall 11' with next to no play. The locking component 50 is guided in a longitudinal groove 53' of a track 53 in a base plate 42 of the plate unit 40, this longitudinal groove 53' extending in the adjustment direction of the plate unit.

Figure 5:
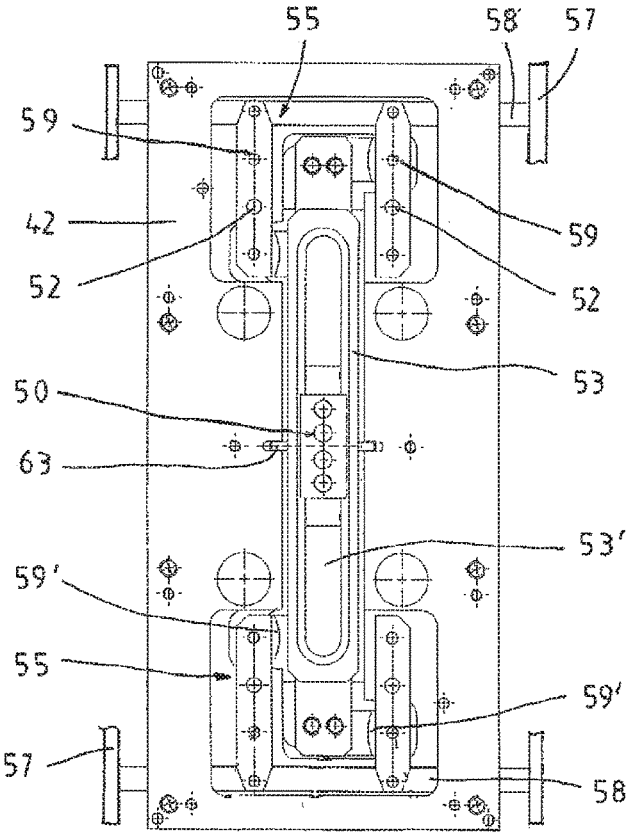
FIG. 5 is a top view of the plate unit, leaving out a counter-element in order to view an actuation device.

According to FIG. 5 there is provided an actuation device 55 co-operating with the track 53 and which serves to evacuate people from the cabin 15 in an emergency. By transversely adjusting outer plates 57 and levers 58 transversely to the longitudinal extension of the track 53 the latter, and with it the locking component 50, are raised, and so unlocking of the locking component is brought about. Correspondingly formed tilt levers 59 are flexibly connected on the one hand to the levers 58 and on the other hand to axes 52, and are on the other hand operatively connected to the track 53 by inclined surfaces 59' located on these tilt levers 59 such that the track, and with it the locking component 50, are raised when the tilt levers 59 are swivelled. The track 53 is held here with cams in grooves 63 in the base plate 42 so as to be able to be raised transversely to this base plate.

In an emergency situation, such as for example if there is a power failure, the shaft doors can be pushed apart by hand, the outer plates 57 being pushed in one or the other direction and the actuation device 55 thus unlocking the locking component 50. For this purpose the shaft door can be opened by key actuation and with the aid of backup batteries.

The invention is sufficiently displayed by the exemplary embodiments described above. However, it could of course also be illustrated by other variations. Thus, for example, the coupling element of the coupling mechanism and the counter-element of the plate unit could be provided by a form-locking coupling as an entraining element of the shaft door with the cabin door.

If two or more such doors were provided for a cabin and for a story, as is illustrated in the publication mentioned at the start, a coupling mechanism and a plate unit would be provided for each leaf door of the cabin and of the story. Two locking components could also be respectively provided here.

The coupling mechanism according to the invention could theoretically also or only with the shaft door be fastened to the respective story, while the plate unit co-operating with the coupling mechanism could be assigned to the moveable cabin door.

Theoretically this locking component 50 could be omitted from the plate unit 40 if locking of the shaft door were released otherwise.

In principle this type of device can also be used in a railway station for mountain railways or aerial cableways in order to open or close a train door or an outer door.

The invention claimed is:

1. A device for actuating first and second movable doors, comprising a coupling mechanism fastenable to the first door; and a plate unit cooperating with the coupling mechanism and fixable onto the second door, the plate unit including a counter-element, the coupling mechanism including a coupling element movable transversely relative to the first door and between a drawn back position not coupled with the counter-element and a position coupled with the counter-element, and the plate unit including a locking component movable from a locked position in which the plate unit and the second door are in fixed positions to an unlocked position in which the plate unit is in a released position and the second door is movable, the locking component moving toward the coupling element when moving from the locked position into the unlocked position.

2. The device according to claim 1, wherein the coupling element of the coupling mechanism and the counter-element of the plate unit are magnetic whereby magnetic adhesive force is generated between the coupling element and the counter-element when the coupling element is coupled with the counter-element.

3. The device according to claim 1, wherein the coupling mechanism further comprises:

a connection configured to connect the coupling mechanism to a drive element; and an adjusting device for moving the coupling element.

4. The device according to claim 3, wherein the connection comprises a rocker connectable to the drive element, the coupling mechanism further comprising a transfer element for coupling the rocker to the adjusting device.

5. The device according to claim 4, wherein the coupling mechanism further comprises a base plate fastened to the first door, the coupling element being movable in a direction perpendicular to the base plate.

6. The device according to claim 5, wherein the adjusting device is fitted to the base plate and comprises a carriage having at least one guide rod and a swivel element hingedly connected to the at least one guide rod such that movement of the at least one guide rod causes movement of the coupling element in the direction perpendicular to the base plate.

7. The device according to claim 6, wherein the carriage is configured to be movable in a direction transverse to the base plate upon movement of the transfer element.

8. The device according to claim 1, wherein the plate unit further comprises a covering plate connectable to the second door, and sliding guides that enable adjustment of a position of the counter-element relative to the covering plate.

9. The device according to claim 8, wherein the locking component is movable in a direction which is transverse to a plane of the covering plate from the locked position to the unlocked position.

10. The device according to claim 8, wherein the plate unit comprises a track defining a longitudinal groove, the locking component being guided for movement in the longitudinal groove of the track, the longitudinal groove extending in a direction in which the plate unit is movable relative to the second door.

11. The device according to claim 10, wherein the plate unit further comprises an actuation device that moves the track in a direction perpendicular to a longitudinal extension of the track to cause unlocking of the locking component and thus enables movement of the plate unit and the second door.

12. The device according to claim 11, wherein the actuation device comprises levers movable from outside of the plate unit, tilt levers flexibly connected to the levers and inclined surfaces located on the tilt levers, the inclined surfaces being operatively connected to the track such that the track, and thus the locking component, is raised when the tilt levers are swiveled by the levers.

13. The device according to claim 8, wherein the locking component is movable in a direction which is transverse to a plane of the covering plate from the locked position which is an initial position to the unlocked position.

14. The device according to claim 1, wherein the first door is a cabin door of a movable elevator cabin and the second door is a shaft door of a building in which the elevator cabin is installed.

15. The device according to claim 1, wherein the coupling mechanism is positioned relative to the first door such that the coupling element is movable in a direction transverse to the first door.

16. The device according to claim 1, wherein the device is for a lift system.

17. The device according to claim 1, wherein the coupling element is in the form of a plate.

18. The device according to claim 17, wherein the coupling mechanism further comprises an adjusting device for moving the coupling element in a direction transverse to the plate.

19. A device for actuating first and second movable doors, comprising a coupling mechanism connected to the first door and including a magnetic coupling element; and a plate unit connected to the second door and including a magnetic counter-element, wherein the coupling element is movable transversely relative to the first door and between a drawn back position not coupled with the counter-element and a position magnetically coupled with the counter-element, and wherein the plate unit includes a locking component movable in a direction transverse to the plate unit between a locked position in which the plate unit and the second door are in fixed positions and an unlocked position in which the plate unit is in a released position and the second door is movable, the locking component moving toward the coupling element when moving from the locked position into the unlocked position.

20. A device for a lift system for actuating first and second movable doors, comprising a coupling mechanism coupled to the first door and including a coupling element; and a plate unit connected to the second door, the plate unit including a counter-element and a locking component, wherein the coupling element is movable transversely relative to the first door and between a drawn back position not coupled with the counter-element and a position coupled with the counter-element, wherein the locking component is movable in a direction transverse to the plate unit from a locked initial position into an unlocked position in which the plate unit is in a released position and the second door is movable, the locking component moving toward the coupling element when moving from the locked position into the unlocked position, wherein the plate unit comprises:

a track defining a longitudinal groove, the locking component being guided for movement in the longitudinal groove of the track, the longitudinal groove extending in a direction in which the plate unit is movable relative to the second door, and an actuation device that moves the track in a direction perpendicular to a longitudinal extension of the track to cause unlocking of the locking component and thus enables movement of the plate unit and the second door.

* * * * *